United States Patent [19]

Pringle

[11] Patent Number: 4,975,224

[45] Date of Patent: Dec. 4, 1990

[54] PROCESS FOR ENCAPSULATION OF OILY LIQUID WASTE MATERIALS

[76] Inventor: Thomas G. Pringle, 85 Henry Lane Terrace, Apt. 427, Toronto, Ontario, M5A 4B8, Canada

[21] Appl. No.: 322,297

[22] Filed: Mar. 13, 1989

[51] Int. Cl.[5] ..... G21F 9/16; G21F 9/22

[52] U.S. Cl. ..... 252/628; 252/633; 264/4.1; 264/4.7; 428/402.21

[58] Field of Search ..... 252/628; 264/4.3; 428/402.21

[56] References Cited

U.S. PATENT DOCUMENTS

| | | | |
|---|---|---|---|
| 4,009,116 | 2/1977 | Bähr et al. | 252/628 |
| 4,077,901 | 3/1978 | Arnold | 252/301.1 W |
| 4,230,597 | 10/1980 | Bustard et al. | 252/628 |
| 4,235,737 | 11/1980 | Pritchard et al. | 252/628 |
| 4,273,672 | 6/1981 | Vassiliades | 264/4.3 |
| 4,382,026 | 5/1983 | Drake | 252/628 |
| 4,400,313 | 8/1983 | Roberson | 252/628 |
| 4,405,512 | 9/1983 | Filter | 252/628 |
| 4,439,488 | 3/1984 | Trimnell | 428/402.24 |
| 4,459,211 | 7/1984 | Carini | 210/751 |
| 4,521,352 | 6/1985 | Hayworth | 264/4.3 |
| 4,528,226 | 7/1985 | Sweeny | 428/40 |
| 4,599,271 | 7/1986 | Chao | 428/402.21 |
| 4,640,709 | 2/1987 | Beestman | 71/100 |

*Primary Examiner*—Robert L. Stoll
*Assistant Examiner*—Joseph D. Anthony
*Attorney, Agent, or Firm*—Ridout & Maybee

[57] ABSTRACT

A novel technique for encapsulating and immobilizing low-level radioactive liquid wastes involves formation of an oil-in-water emulsion, encapsulation of the individual oil droplets by interfacial condensation and subsequent incorporation of the encapsulated oil suspension into a curable polyester resin. Stable and strong wasteforms may thus be produced containing up to about 40% by volume of entrapped oil.

9 Claims, 1 Drawing Sheet

CONTINUOUS WASTE IMMOBILIZATION PROCESS

PROCESS FOR ENCAPSULATION OF OILY LIQUID WASTE MATERIALS

The present invention relates to a method for the immobilization of organic liquid waste in a solid matrix, for transportation and either storage or disposal.

The shortcomings of earlier "oil solidification" processes involving the taking up of oily liquid wastes in solid absorbents are well recognized. The absorbent materials used have exhibited either a low capacity for organic waste, or else fail to retain the waste upon immersion in water.

For the disposal of aqueous waste solutions, such as radioactive waste produced by nuclear power plants, some success in disposal has been achieved by uniformly dispersing the waste in a liquid thermosettable polymer composition and thereafter curing the waste/-polymer dispersion to a solid. Such techniques are illustrated in U.S. Pat. Nos. 4,077,901 (Arnold); 4,400,313 (Roberson); and 4,459,211 (Carini).

It became apparent, however, that organic solvent wastes and oils were not amenable to disposal in the same way as aqueous waste because of chemical incompatibility of the organic waste materials with resin matrices. A modification of the technique for application to organic waste materials is disclosed in U.S. Pat. No. 4,405,512 (Filter), involving the aqueous dilution of waste to the degree that prior encapsulation techniques become operable. The liquid organic waste is diluted in water prior to dispersion in a curable resin system, so that the amount of waste in the uncured resin phase is at a level below that which will retard the cure rate or adversely affect physical properties of the cured product. This necessarily results in low oil loadings in the final product, however, and may not be practical where a substantial quantity of strongly hydrophobic waste material must be disposed of.

U.S. Pat. No. 4,382,026 (Drake) also recognizes the shortcomings of previous techniques when applied to organic solvent wastes such as oils, and proposes as a solution the taking up of such waste in particles of polymers having the property of being substantially insoluble in, but capable of being swollen by the organic liquid waste. The loaded polymer particles are dispersed in an emulsion of water in a curable liquid resin in the ratio of between 1:10 and 3:1 particles to resin. The resin is then cured to a solid with the gelled particles encased therein. This process, too, has low oil loadings, and the long-term stability of the uncured polyester emulsion is open to question, since the oil-swollen polymer particles promote de-emulsification of the water-in-resin emulsion.

It is a particular object of the present invention to provide a safe and efficient method for immobilizing organic liquid low-level radioactive waste (LLRW) produced as byproducts of nuclear generator operations. Typical such LLRW include lubricating oils, scintillation fluids, and Freon dry cleaning effluent, containing moderate levels of tritium, carbon-14, PCBs, or other toxic materials which preclude incineration. For such LLRW the aforementioned known encapsulation techniques are unsatisfactory.

SUMMARY OF THE INVENTION

The invention stems from the discovery that a water suspension of organic waste-containing microcapsules can be added under agitation to an unsaturated, water-extendible polyester (WEP) resin such as AROPOL WEP 661-P (Ashland Chemicals) to form a stable suspension-in-ester emulsion. The emulsion may then be hardened by curing the loaded ester with a free-radical such as a peroxide. Waste loadings of up to 44% contaminated turbine oil by volume have been achieved in the final product, which is a free-standing monolithic solid having oil-containing microcapsules and water encapsulated within the polyester matrix.

The first step in the immobilization of an organic lipophilic waste liquid in a solid matrix according to the method of the invention is preparing a solution or dispersion of a suitable polyfunctional lipophilic reagent in the waste liquid. The reagent chosen is one which will form a solid condensation polymer, by interfacial condensation, with a selected hydrophilic polyfunction reagent. The solution of lipophilic reagent in waste liquid is then mixed with an aqueous solution of an emulsifying agent to form a waste-in-water emulsion. Mixing that emulsion with an aqueous solution of the hydrophilic reagent produces a discrete phase, comprising an aqueous suspension of waste-containing microcapsules.

The aqueous suspension of waste-containing microcapsules is removed when the interfacial condensation is complete and is agitated in a curable water-extendible liquid resin to form a water-in-resin emulsion containing the microcapsules. Finally, a free-radical initiator is added to the water-in-resin emulsion and the resin is cured to form a solid matrix (wasteform) containing the microcapsules. It has now been found that nylon-based microcapsules of waste lubricating oils provide especially stable emulsions when dispersed in the ester phase prior to polymerization, possibly owing to the hydrophilic nature of this polymeric material.

Other objects and advantages of the method of the present invention will be apparent from the detailed description which follows. In a drawing which is illustrative of the invention:

DETAILED DESCRIPTION OF THE PREFERRED EMBODIMENT

Figure 1:
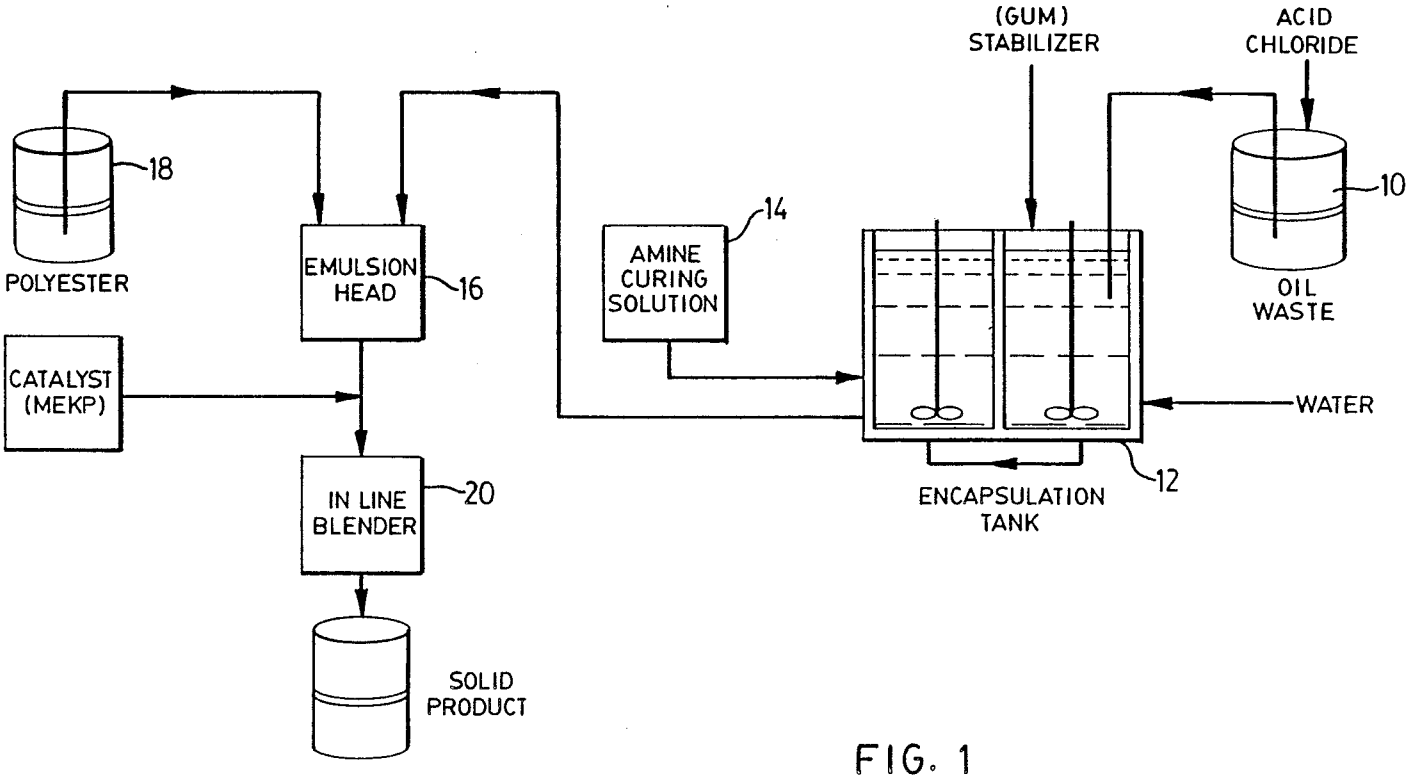
FIG. 1 is a schematic drawing of a system for carrying out the immobilization of liquid organic waste by the method of the invention, as applied in a continuous process.

Methods of encapsulation by interfacial condensation are well-known as disclosed, for example in U.S. Pat. No. 3,429,827 (Ruus). Microencapsulation of liquid waste suggested a method whereby the waste would be physically isolated and could at the same time be given a hydrophilic surface rendering it amenable to further encapsulation in a solid wasteform.

Table 1 sets out various reagent systems which may be used to form microcapsules of organic liquid waste:

TABLE 1

| Microcapsular Shell Material | Lipophilic Reagent | Hydrophilic Reagent |
|---|---|---|
| polyester | terephthaloyl chloride and trimesoyl chloride | ethylene glycol |
| polyureylene | 4,4 diphenylmethane-di-isocyanate | 1,6-hexanediamine |
| polyurethane | 4,4 diphenylmethane-di-isocyanate | polyol/catalyst mixture |
| polyamide | terephthaloyl or | 1,6-hexanediamine |

TABLE 1-continued

| Microcapsular Shell Material | Lipophilic Reagent | Hydrophilic Reagent |
|---|---|---|
| | sebacoyl chloride and trimesoyl chloride | |

In the preferred nylon-based system, an oil-soluble dicarboxylic acid chloride such as terephthaloyl or sebacoyl chloride is reacted with an aqueous polyamine solution (e.g., 1,6-hexanediamine) to produce an interfacial membrane of polyamide surrounding droplets of oil, according to the following reactions:

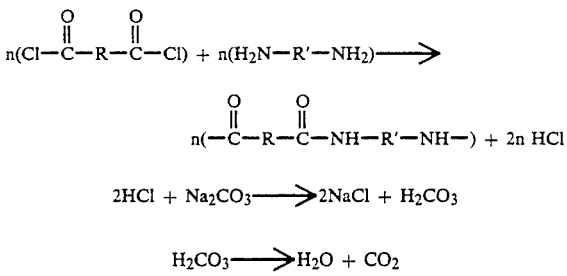

Hydrogen chloride produced by the condensation is neutralized by excess diamine or, more efficiently, by a suitable salt (sodium carbonate). Sebacoyl and terephthaloyl chlorides were chosen because of their low solubility in water and hence extremely slow rates of hydrolysis.

Initial tests were performed using inactive lubricating oil (Teresso 32) as the microcapsule core material. Diacid chloride was dissolved in the oil and this solution was dispersed in an aqueous phase containing acacia gum to maintain the dispersion.

A second aqueous solution of diamine, acacia gum and sodium carbonate was added during stirring, instantaneously producing buoyant capsules. Under a microscope, the capsules so produced ranged from 10 to 100 microns in diameter. The fragile nature of the capsules necessitated their separation from the liquid phase, emulsification of the aqueous liquid phase with polyester resin, recombination of this emulsion with the capsules at low stirring speed and subsequent catalysis with methyl ethyl ketone peroxide (MEKP).

Capsules made using diethylene triamine were found to inhibit catalysis of the water-extendible polyester resin. Either diethylene triamine in a solution of greater than 0.3% or the presence of a polyamide made with this amine apparently prevented catalysis, presumably owing to the presence of an unreacted secondary amine group. The use of 1,6-hexanediamine presented no such problems and waste loadings of up 35% v/v were successfully attained.

Higher waste loadings (up to 44%) and emulsification without a need for capsule separation were achieved by adding small amounts of a trifunctional carboxylic acid, trimesoyl trichloride, to the oil phase. Crosslinking of the polyamide was thereby promoted, thus rendering the capsule walls strong enough to survive stirring at high speed. The resulting WEP emulsion has similar stability to a plain WEP emulsion (many days).

It is important that the concentration of acid chloride first dissolved in the oil be sufficient to ensure substantially complete encapsulation of the oil in the interfacial condensation reaction, since any free oil will destabilize the later formed water-in-resin emulsion. It was found that sufficient encapsulation could be ensured by using 8.8 g of terephthaloyl chloride and 0.83 g of trimesoyl trichloride per litre of waste oil. However, the amounts of polyacid chloride and diamine required to effect complete encapsulation will depend upon the oil droplet surface area and, accordingly, will be functions of both the emulsification speed and the type and concentration of the emulsifier.

Stoichiometric ratios of amine (dissolved in the water phase) to acid functional groups (dissolved in the waste oil) of between 0.9 and 1.1 were used successfully in the interfacial condensation reaction. Excess diamine (diamine/acid ratio greater than about 1:1) adversely affects the subsequent curing of the water-extendible polyester. Sub-stoichiometric quantities of diamine are acceptable, however, since not all of the acid halide will immediately migrate to the forming microcapsular walls.

Optionally, emulsion stabilizers such as methocel and acacia gum may be added to the initial oil-in-water emulsion. These are useful in ensuring the production of small and therefore strong capsules, by providing good oil dispersion.

EXPERIMENTAL EXAMPLE 1 : BATCH PROCESS

Terephthaloyl chloride and trimesoyl chloride in the proportions listed below were dissolved in waste turbine lubricating oil to form Solution A. Solution A was emulsified in Solution B for 15 minutes using a large low-speed mixer in a 10L pail. Solution C was added slowly and stirred for about 5 minutes. A discrete phase of smooth yellowish appearance was seen to form at the surface of the mixture, which examined under a microscope was found to consist of discrete microcapsules (10–300 micron diameter). When some of these capsules were placed under sufficient pressure to break the capsule walls, oil was released.

The microcapsule suspension was added under agitation to 1.6 kg of a commercially available unsaturated polyester resin/styrene solution, AROPOL WEP 661-P, and a stable water-in-polyester emulsion was seen to form. AROPOL WEP 661-P is a low viscosity, prepromoted isophthalic resin made by Ashland Chemicals, but other curable, water-extendible polyester resins may be used.

Aropol WEP 661-P has a percentage styrene content of between 57 and 60%. The viscosity of the Aropol resin itself (Brookfield at 77° F., #1 spindle at 30 rpm) is between 120 and 180 cps. In a 60% water emulsion, the viscosity of the Aropol product (Brookfield at 85° F., LVT #3 spindle at 30 rpm) is between 2,300 and 3,500 cps. The acid number of the solids base resin before promotion is between 8 and 12 and the specific gravity of the resin is 1.03.

The typical curing characteristics of Aropol WEP 661-P at room temperature for water emulsions prepared at 85° F. is set out in the following table. The data refers to a cure in which 0.75% (based on resin) of a 35% aqueous solution of hydrogen peroxide was used as catalyst. Other catalysts such as Lupersol DSW (Pennwalt-Lucidol), Norox W-60 (Norac Chemical), Percadox 48 (Noury Chemical Co.) or Aposet 720 (Apogee) are satisfactory but should be used at a 1% level, based on resin.

| | 50% Water | 60% Water |
|---|---|---|
| Viscosity | 1,200 | 2,800 |
| Gel Time, minutes | 3.0 | 4.0 |
| Total Time, minutes | 7.0 | 8.0 |
| Peak Exotherm, °F. | 205 | 175 |

To this water-in-WEP emulsion and under agitation an organic peroxide (MEKP 130 mL) was added to cure the polyester thus forming a hard freestanding monolithic solid. The oil-containing capsules and water were contained within the polyester matrix.

| | |
|---|---|
| Solution A: | 2 L lubricating oil (Teresso 32), 14.9 g of terephthaloyl chloride dissolved in 60 mL xylene 1.4 g of trimesoly chloride dissolved in 28 mL acetone |
| Solution B: | 1300 mL water 85 g acacia gum |
| Solution C: | 280 mL water 14 g acacia gum 9.9 g hexamethylene diamine 21.1 g sodium carbonate |

Final organic waste loading was 35% by volume in the solid wasteform. 5cm. cubes were cut from the 5 litre solid wasteform for testing of physical properties. Compressive strength at which oil exuded from the form was measured to be 300 psi. Release of the oil was negligible when the wasteform was immersed in water for 300 days. It should be noted that, in this example, the quantities of acid chloride and diamine reactants are from a practical point of view near the minimum quantities for effective encapsulation of the stated quantity of turbine oil within a reasonable reaction time (between 5 and 30 minutes). The presence of a minor amount of a trifunctional reactant (trimesoyl chloride) serves to provide strong capsular walls through crosslinking.

Table 2 illustrates the effect of polyester resin content on the final compressive strength of the wasteform. Samples A to E were each prepared by the batch process of Example 1, scaled down to 60 g (~71 mL) of oil. In each case a fixed amount of capsules-in-water suspension was stirred into the quantity of polyester resin indicated in the third column of Table 2. That is, by decreasing the absolute amount of polyester resin from A to E, the relative percentages of water and oil increase while their absolute volumes remain constant. Referring to Sample B, the total volume of the wasteform was 71[vol. of oil]/32%=222 mL.

TABLE 2

| Sample | Waste Oil Loading (% Vol) | Polyester Resin (g) | Polyester Resin (% Vol) | Compressive[1] Strength (MPa) |
|---|---|---|---|---|
| A | 27 | 128 | 50 | 4.6 |
| B | 32 | 85 | 40 | 4.9 |
| C | 36 | 57 | 31 | 3.2 |
| D | 39 | 45 | 26 | 2.7 |
| E | 44 | 35 | 21 | 2.0 |

[1]loading at which oil exudes from wasteform.

The waste content of the solidified product depends upon the compositions of both the oil-in-water emulsion and the waste-in-polyester emulsion. A characteristic of WEP emulsions is an increasing viscosity in direct proportion to the water content. More than 70% mass of water renders the product too stiff for processing. Oil-in-water emulsions resist inversion at up to about 70% v/v internal oil phase, lowered by addition of the diamine curing solution to about 66%. Accordingly, the practical maximum waste loading for immobilized and encapsulated oil is approximately 0.70×0.66 =46% v/v. A number of immobilized products were successfully produced at 44% v/v oil, however the uncured emulsion was too viscous to pour or to be efficiently processed. The final effective waste loading of the immobilized waste can be potentially increased, however, by substituting aqueous liquid waste for the water phase used in preparing the oil-in-water emulsion.

Specimens prepared according to the method of the invention, despite a high oil content, exhibited good resistance to flame. Exposure to eight 48-hour freeze/-thaw cycles at −23° C. and 23° C. produced no visible deterioration of the test specimens.

EXPERIMENTAL EXAMPLE 2 : CONTINUOUS PROCESS

A continuous waste immobilization process employing the method of the invention is schematically illustrated in FIG. 1. In liquid waste tank 10, terephthaloyl chloride (90 g) in xylene solution and trimesoyl trichloride (8.5 g) in acetone solution are dissolved in Teresso 32 oil (12 L). This solution is pumped into stirred encapsulation tank 12 containing a solution of 600 g of acacia gum in 48 L of warm water. Stirring at high speed is carried out to form the initial oil-in-water emulsion.

From tank 14, the amine curing solution consisting of 60 g hexanediamine, 80 g acacia gum and 130 g sodium bicarbonate dissolved in two litres of water is added gradually to the oil-in-water emulsion in tank 12 and mixing is continued at a brisk speed to provide thorough liquid movement.

After between 5 and 15 minutes, the mixing speed is reduced until just sufficient to maintain a homogeneous suspension of encapsulated oil in water.

The microcapsular suspension is combined in emulsion head 16 with WEP resin pumped from drum 18 and the final water-in-polyester emulsion is catalyzed with MEKP (6% by weight of resin) by way of line blender 20, to produce the solid wasteform.

It will be appreciated by those skilled in the art that microencapsulation of oily liquid waste by interfacial polycondensation, so as to produce an aqueous suspension of microcapsules, could be carried out using any of a wide variety of coreactants, one soluble in the oil waste and the other soluble in the aqueous phase. The lipophilic reactant could, for example, be a diacid chloride, a disulphonyl chloride, or mixtures thereof. The hydrophilic reactant could be a polyamine or polyol, such as bisphenol A, thus forming microcapsules having polyamide or copolyamide walls.

I claim:

1. A process for encapsulating lipophilic liquid waste into a solid matrix for storage or disposal, comprising:

(a) preparing a dispersion in said waste of a selected lipophilic polyfunctional reactant capable of forming a solid condensation polymer with a selected hydrophilic polyfunctional reactant by interfacial condensation;

(b) mixing said dispersion with an aqueous solution of stabilizing agent, to form a uniform oil-in-water emulsion;

(c) admixing said emulsion with an aqueous solution of said selected hydrophilic polyfunctional reactant, whereby a liquid suspension of waste-containing microcapsules is formed;

(d) agitating said suspension with a curable water-extendible liquid resin to form a water-in-resin emulsion containing said microcapsules; and (e) adding a catalyst to said water-in-resin emulsion to cure said resin and form a solid matrix containing said microcapsules.

2. A process according to claim 1, wherein said curable, water-extendible liquid resin is an unsaturated polyester, a vinyl ester resin, or a mixture thereof, and said catalyst is a free-radical initiator.

3. A process according to claim 2, wherein said lipophilic polyfunctional reactant is a polyacid chloride and said hydrophilic polyfunctional reactant is a polyamine.

4. A process according to claim 3, wherein said lipophilic liquid waste is a lubricating oil.

5. A process for preparing a solid wasteform containing immobilized waste oil, for disposal, comprising the steps of:

(a) dispersing in the oil to be disposed of a first reagent comprising at least one acid chloride from the group consisting of terephthaloyl chloride and sebacoyl chloride;

(b) emulsifying the oil dispersion produced in step (a) in water containing a stabilizing agent to form droplets;

(c) mixing the emulsion produced by step (b) with an aqueous solution of a second reagent comprising a difunctional amine, to produce an aqueous suspension of encapsulated waste oil by interfacial condensation;

(d) mixing said aqueous suspension of encapsulated waste oil with a curable, water-extendible polyester resin; and (e) curing the mixture produced by step (d) to a solid wasteform.

6. A process according to claim 5, wherein the ratio of amine functional groups from said second reagent to acid chloride functional groups from said first reagent is less than 1:1.

7. A process according to claim 5, wherein said first reagent further comprises trimesoyl chloride.

8. A process according to claim 7, wherein said second reagent is 1,6-hexanediamine.

9. A process according to claim 5, wherein said curable, water-extendible polyester resin is AROPOL WEP 661-P.*

* * * * *